US008690742B1

(12) United States Patent
Herman et al.

(10) Patent No.: US 8,690,742 B1
(45) Date of Patent: Apr. 8, 2014

(54) RESISTANCE BAND PHYSICAL TRAINING APPARATUS AND RELATED METHODS

(76) Inventors: David Herman, Orlando, FL (US); Robert Edward Herman, Dade City, FL (US)

( * ) Notice: Subject to any disclaimer, the term of this patent is extended or adjusted under 35 U.S.C. 154(b) by 226 days.

(21) Appl. No.: 13/420,181

(22) Filed: Mar. 14, 2012

Related U.S. Application Data

(60) Provisional application No. 61/452,183, filed on Mar. 14, 2011.

(51) Int. Cl.
*A63B 21/00* (2006.01)

(52) U.S. Cl.
USPC ..... 482/129; 482/121; 482/904

(58) Field of Classification Search
USPC ..... 482/121, 129, 126, 904, 142
See application file for complete search history.

(56) References Cited

U.S. PATENT DOCUMENTS

| | | | | |
|---|---|---|---|---|
| 5,997,448 | A * | 12/1999 | Duba | 482/121 |
| 6,319,179 | B1 * | 11/2001 | Hinds | 482/121 |
| 6,908,418 | B2 * | 6/2005 | Saure | 482/121 |
| 7,625,325 | B1 * | 12/2009 | Yost | 482/129 |
| 2002/0123415 | A1 * | 9/2002 | Marques | 482/123 |
| 2003/0158024 | A1 * | 8/2003 | Saure | 482/126 |
| 2003/0186792 | A1 * | 10/2003 | Keeler | 482/129 |
| 2011/0195822 | A1 * | 8/2011 | Donofrio | 482/93 |
| 2012/0129663 | A1 * | 5/2012 | Dunn | 482/129 |

* cited by examiner

*Primary Examiner* — Jerome w Donnelly
(74) *Attorney, Agent, or Firm* — Allen, Dyer, Doppelt, Milbrath & Gilchrist, P.A.

(57) ABSTRACT

A resistance band physical training apparatus includes a wall station, and a pair of floor stations. The wall station is mounted to a vertical mounting surface, such as a wall, and the floor stations are mounted to a horizontal mounting surface, such as a floor. The wall and floor stations include rods and bars about which resistance bands can be arranged to facilitate the performance of a plurality of exercises.

20 Claims, 11 Drawing Sheets

RESISTANCE BAND PHYSICAL TRAINING APPARATUS AND RELATED METHODS

CROSS-REFERENCE TO RELATED APPLICATION

This application claims the benefit of U.S. Provisional Application Ser. No. 61/452,183, filed on Mar. 14, 2011, the contents of which are herein incorporated by reference in their entirety.

FIELD OF THE INVENTION

The present invention relates to resistance bands used for physical training, and more particularly, to apparatus to facilitate the use of resistance bands.

BACKGROUND OF THE INVENTION

Resistance bands are known to be a valuable physical training tool. In particular, they offer great flexibility in terms of particular exercises that can be performed. Additionally, resistance bands are readily transportable, allowing users to perform all or part of their accustomed exercise routine even when traveling. Despite these advantages, further improvements in the use of resistance bands in physical training are possible.

SUMMARY OF THE INVENTION

In view of the foregoing, it is an object of the present invention to provide a resistance band physical training apparatus and related methods. According to an embodiment of the present invention, a resistance band physical training apparatus includes a wall station, and a pair of floor stations. The wall station is mounted to a vertical mounting surface, such as a wall, and the floor stations are mounted to a horizontal mounting surface, such as a floor.

The wall station has a vertically mounted elongated wall station rod, a plurality of wall station cross bars extending perpendicularly to the elongated wall station rod, each of the wall station cross bars having a wall station plate on at least one end thereof, a wall station plate diameter being greater than a wall station cross bar diameter, and at least one wall station post extending perpendicularly to the elongated wall station rod and the plurality of wall station cross bars, the at least one wall station post holding the elongated wall station rod and the plurality of wall station cross bars parallel to and spaced apart from a vertical mounting surface.

The pair of floor stations each have an elongated floor station rod mounted in a vertical orientation spaced apart from and perpendicular to the elongated wall station rod, the elongated floor station rod having a floor station plate on at least one end thereof, a floor station plate diameter being greater than a floor station elongated rod diameter, and at least one floor station post extending perpendicularly to the elongated floor station rod, the at least one floor station post holding the elongated floor station rod parallel to and spaced apart from the horizontal mounting surface.

At least one resistance band is releasably accommodatable by the wall station, either of the floor stations, or a combination thereof to facilitate exercise therewith.

Method aspects of the invention include the use of the resistance band physical training apparatus to perform a plurality of exercises using one or more resistance bands.

These and other objects, aspects and advantages of the present invention will be better appreciated in view of the drawings and following detailed description of preferred embodiments.

DETAILED DESCRIPTION OF PREFERRED EMBODIMENTS

Figure 1:
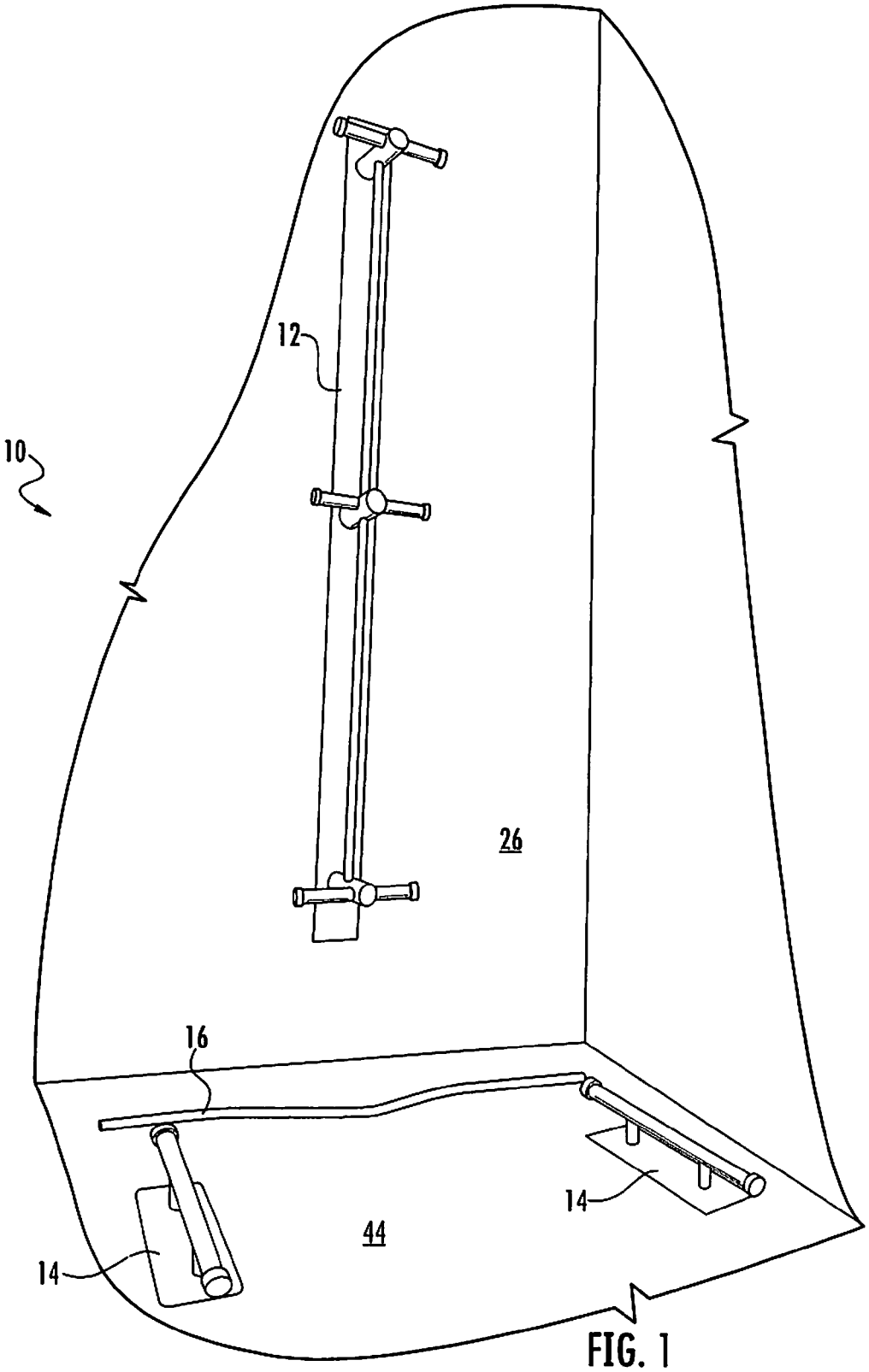
FIG. 1 is a perspective view of a resistance band physical training apparatus, including a wall station, floor stations and accessories, according to an embodiment of the present invention.

Referring to FIG. 1, according to an embodiment of the present invention, a resistance band physical training apparatus 10 includes a wall station 12, floor stations 14 and accessories 16. The wall station 12 and floor stations 14 are affixed to the wall and floor, respectively, and adapted to receive resistance bands 20 (see, e.g., FIG. 5) in a plurality of configurations to allow for a plurality of exercises. The accessories 16 are usable in connection with the bands 20 and the wall and/or floor stations 12, 14 to allow for additional exercises.

Figure 2:
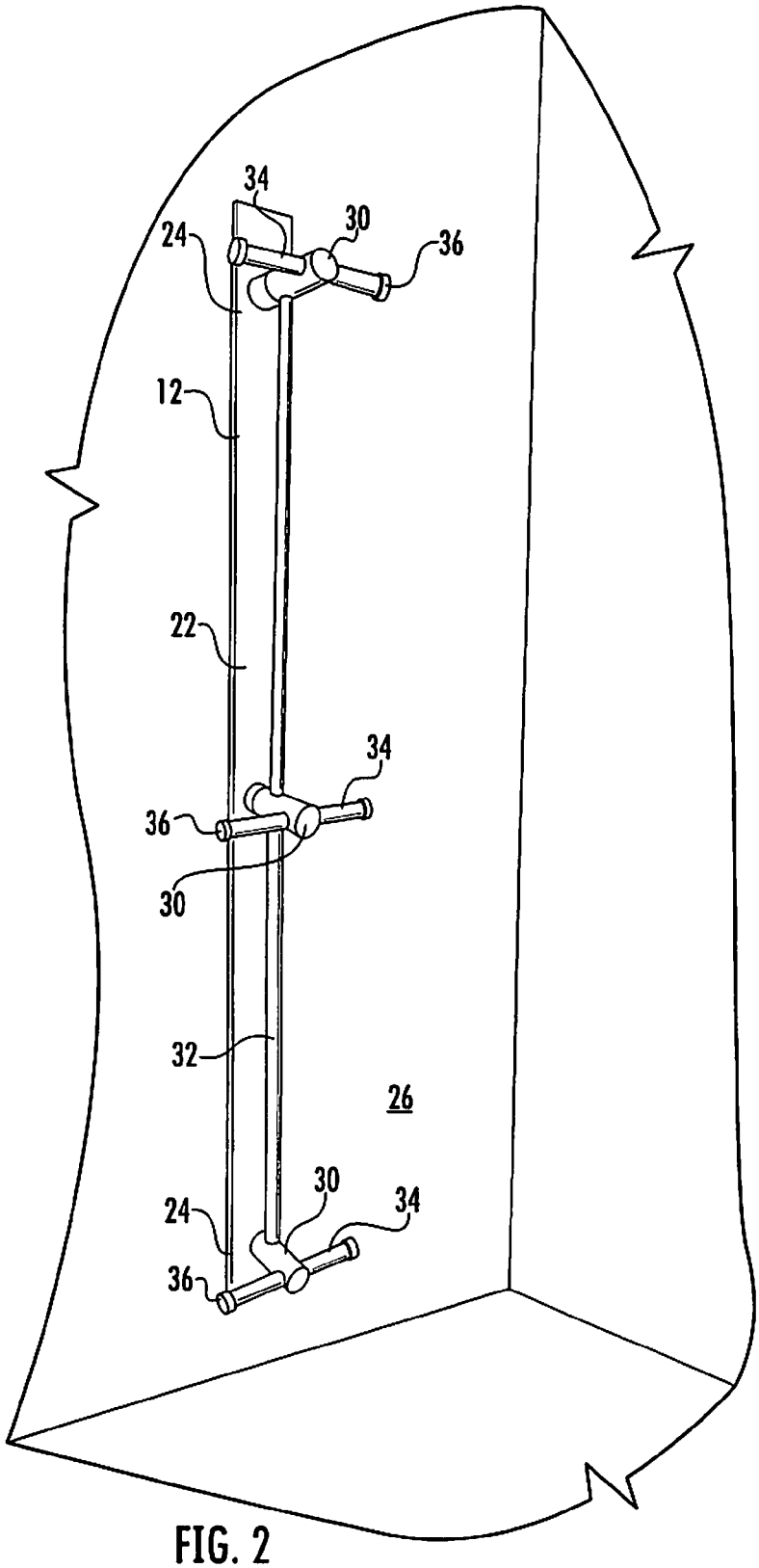
FIG. 2 is a perspective view of the wall station of FIG. 1.

Referring to FIG. 2, the wall station 12 includes a back plate 22 having a plurality of mounting points 24 thereon for secure attachment to an underlying wall 26, or other vertical mounting surface. A plurality of horizontally-aligned posts 30, preferably three, extend outwardly from the back plate 22 generally parallel with the floor. An elongated vertical rod 32 extends between the posts 30 generally parallel with the back plate 22. Each post 30 has a cross bar 34 forming a "T" therewith, extending generally perpendicular to the vertical rod 32 and parallel with the floor. Each cross bar 34 has a pair of increased diameter plates 36 on opposite ends thereof.

Figure 3:
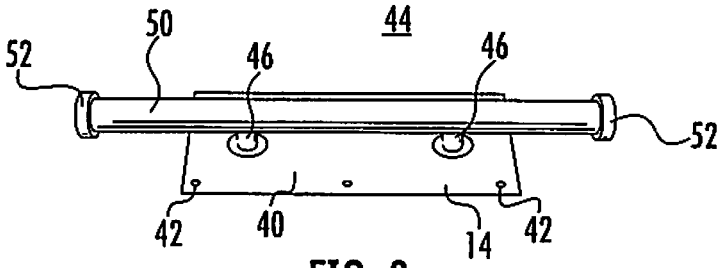
FIG. 3 is a perspective view of one of the floor stations of FIG. 1.

Referring to FIG. 3, each floor station 14 (only one shown in FIG. 3) includes a bottom plate 40 having a plurality of mounting points 42 thereon for secure attachment to an underlying floor 44, or other horizontal mounting surface. A plurality of support posts 46, preferably two, support an elongated rod 50 above the backplate 40 extending generally parallel with the floor 44 and generally perpendicular to the backplate 22 of the wall station 12. Each end of the rod 50 has an increased diameter plate thereon 52.

Figure 4:
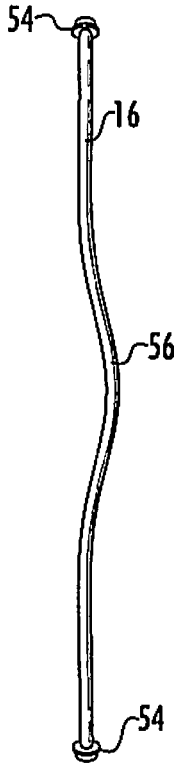
FIG. 4 is a perspective view of one of the accessories of FIG. 1.

Referring to FIG. 4, one accessory usable with the wall and/or floor stations is an exercise bar 16. The exercise bar has a pair of increased diameter plates 54 on opposite ends thereof and preferably has a generally centrally located curved section 56. While the bar of FIG. 4 is an advantageous accessory for the wall and/or floor stations 12, 14, it should be appreciated that other resistance band accessories are also usable therewith.

Preferably, the wall and floor stations 12, 14 and the accessory bar 16 are made entirely from metal, such as aluminum or stainless steel and feature all-welded construction. With respect to the wall station 12, advantageously, the vertical rod 32 extends through a hole in a middle one of the posts 30 and terminates at either in end in holes in upper and lower posts 30. Once the vertical rod 32 has been assembled with the posts 30 in this manner, the posts 30 can be welded to the back plate 22 and the vertical rod 32 can be welded to the posts 30. Also, each cross bar 34 is preferably inserted through a hole in a respective one of the posts 30 and then welded thereto.

It will be appreciated that the resistance band physical training apparatus 10 provides a plurality of points for locating resistance bands 20, greatly facilitating the performance of multiple exercises. A plurality of exercises that are performable with the training apparatus are described in detail below, with reference to FIGS. 5-22.

Figure 5:
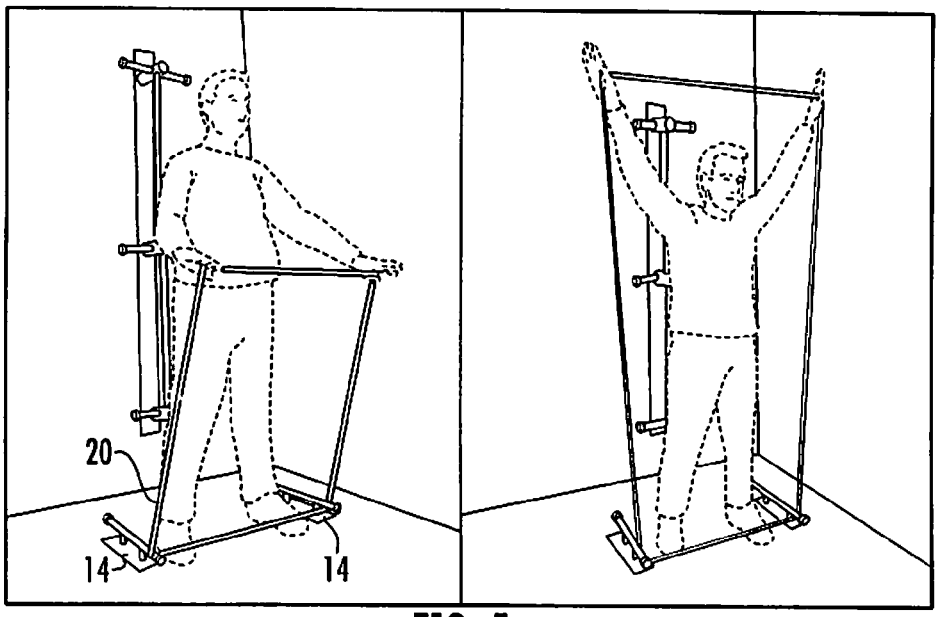
FIGS. 5-22 are illustrations of exercises using the training apparatus of FIG. 1.

FIG. 5. Shoulder Sweep

Standing aligned in the center of the floor stations 14, loop band 20 under the floor stations 14 while grabbing the other end of the band with both hands approximately 18 inches apart. With thumbs down raise the band 20 forward and up in front of the body and above the head creating a Y look with both arms. Release band 20 back down to starting position and repeat.

Figure 6:
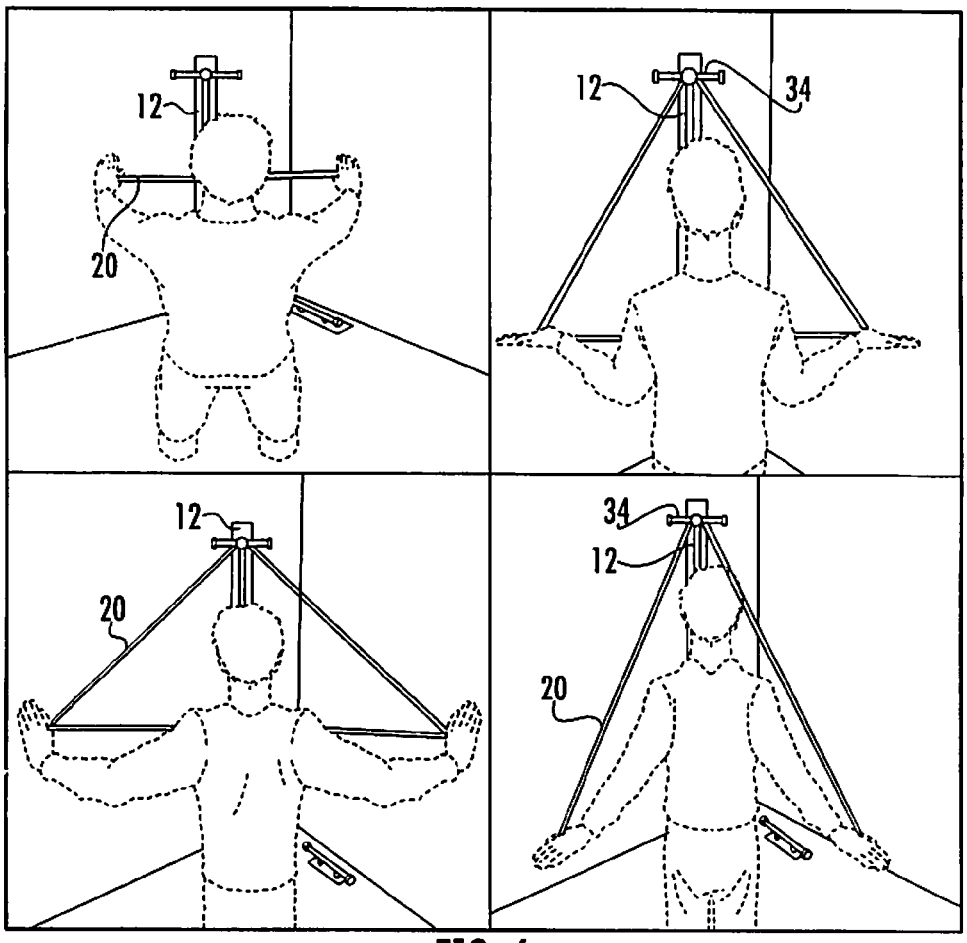

FIG. 6. Standing T's, W's, V's

Standing aligned to the center of the wall station 12 while looping band 20 shoulder height around center or top wall station cross bar 34. Grab other end of band 20 with both hands about 18 inches apart with arms reaching forward and parallel to ceiling. With fingers pointing up and then back, simultaneously with both arms perform a rear deltoid shoulder fly movement emulating T's, W's and V's for scapular strengthening and stabilization.

Figure 7:
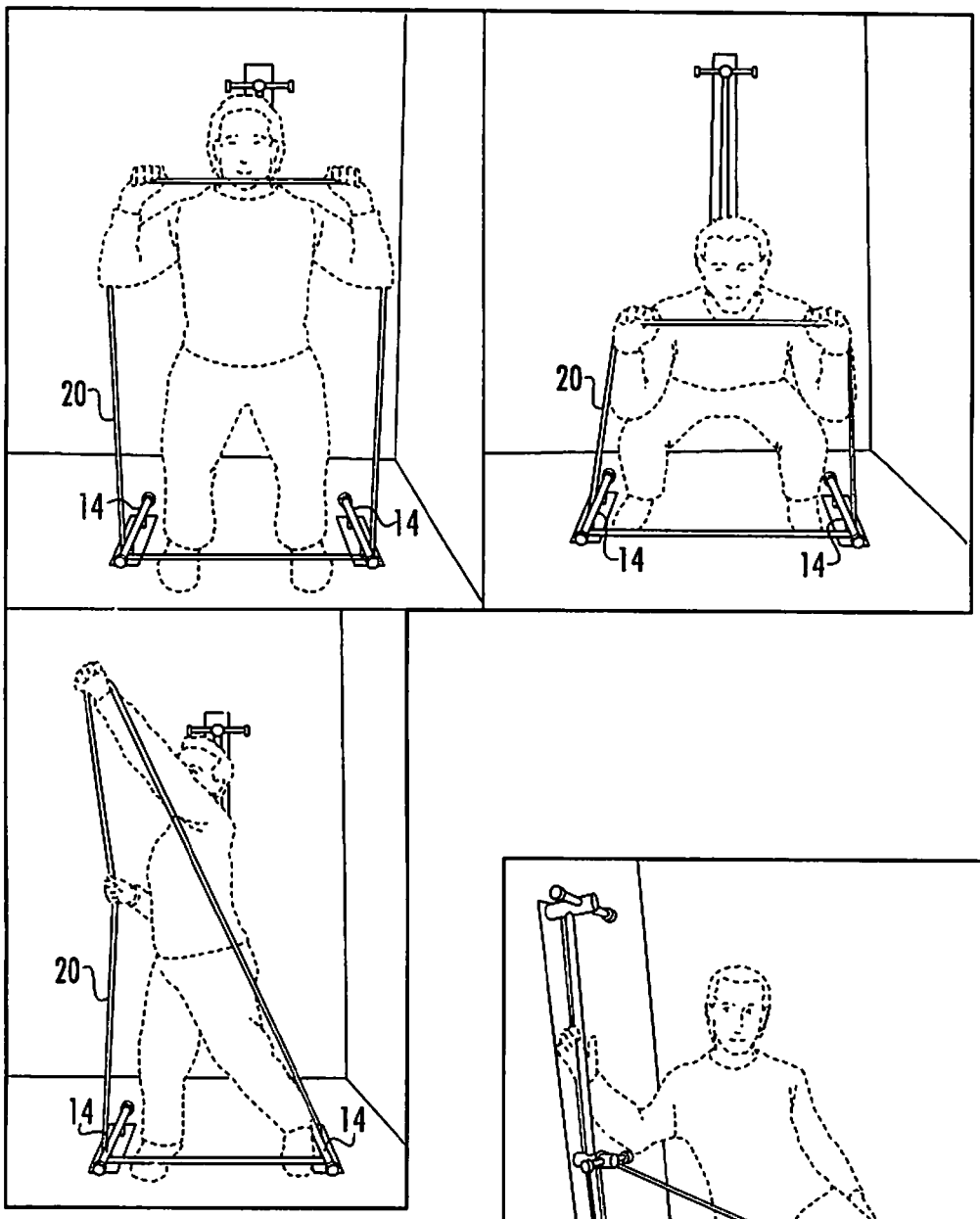

FIG. 7. Squat Press to One Arm Shoulder Press

Standing aligned in the center of the floor stations 14, loop band 20 under the floor stations 14 while grabbing the other end of the band 20 with both hands approximately 18 inches apart at chest height and at shoulder width apart. Begin exercise by squatting down to a comfortable position and explode up as you drive and rotate with one arm, return to position and repeat other side.

Figure 8:
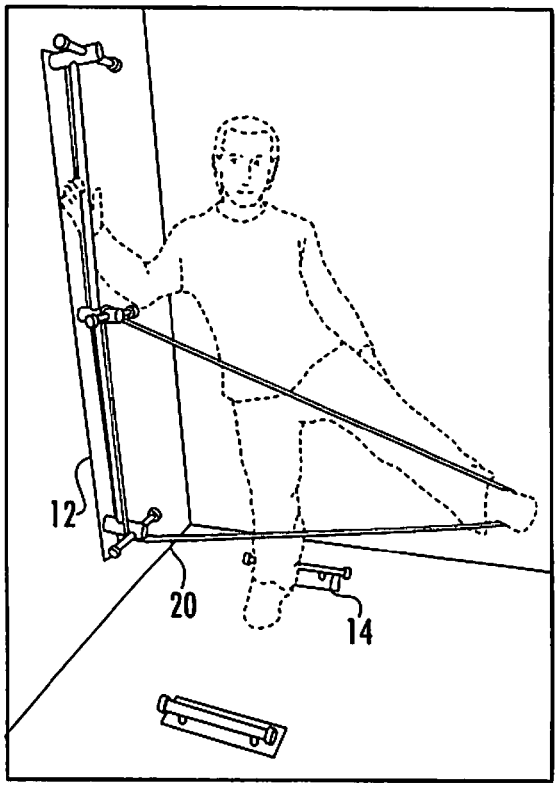

FIG. 8. Standing Hip Abduction

Standing sideways approximated 2-3 feet away from the floor station 14 or wall station 12. Loop band 20 around floor station 14 or wall station 12 while looping other end around the outside foot. Shift balance to stable leg and then raise banded leg up and out to 45-60 degrees. Return to position and repeat.

Figure 9:
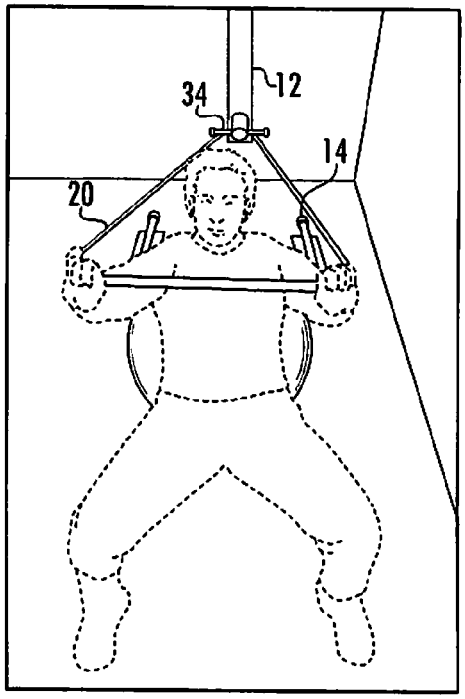

FIG. 9. Abdominal Crunch on Ball

Loop band 20 around both floor stations or around lower cross bar 34 on wall station 12. Position stability ball approximately 2-3 feet from each station. Lean back against ball while placing lower back against the ball. Bring band 20 up and over, then engage abdominals and slowly or quickly performing abdominal crunches.

Figure 10:
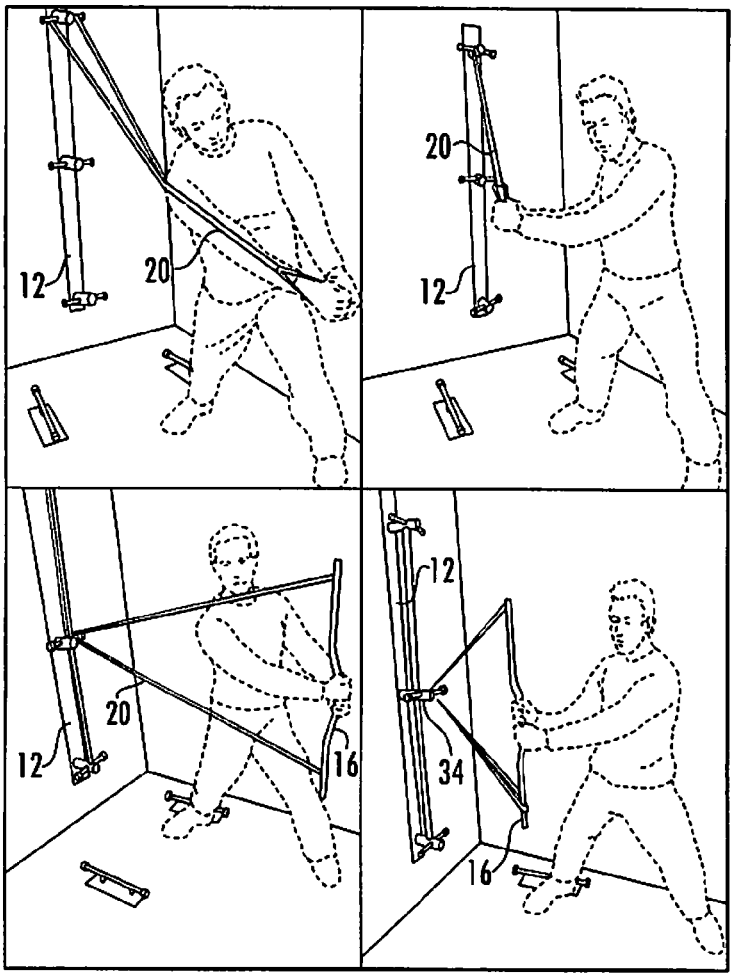

FIG. 10. Standing Core Rotations (Bar Optional)

Standing sideways to wall unit with feet slightly wider than a neutral stance, double loop the band 20 around the center cross bar 34 of wall station 12. Grasping the other end of the double loop band 20 and both hands, slightly pull elbows into body and then rotate or explode through and across the body. Imagine your sliding both hands over the top of a smooth table. Release slowly back to starting position and repeat.

Figure 11:
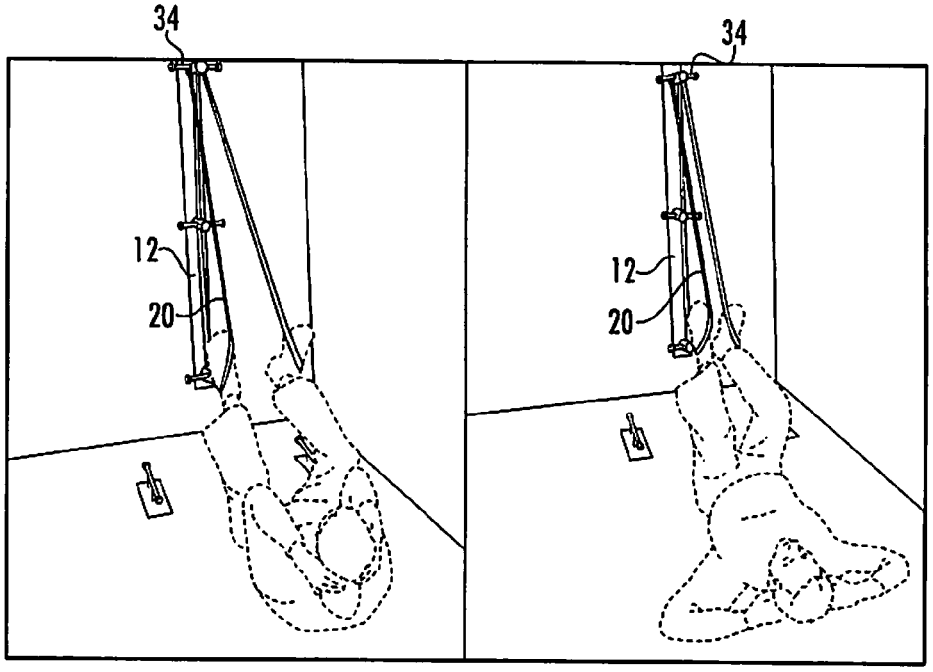

FIG. 11. Lying Abdominal Crunches

Loop one end of the band 20 around the top cross bar 34. Lay on the ground approximating 2 feet from the wall station 12 while placing both feet in other end of band 20. Pull knees toward body creating a 90-degree's knee angle while engaging low abdominals. Slowly crunch forward while engaging the knee's in a stationary position. Reload and repeat.

Figure 12:
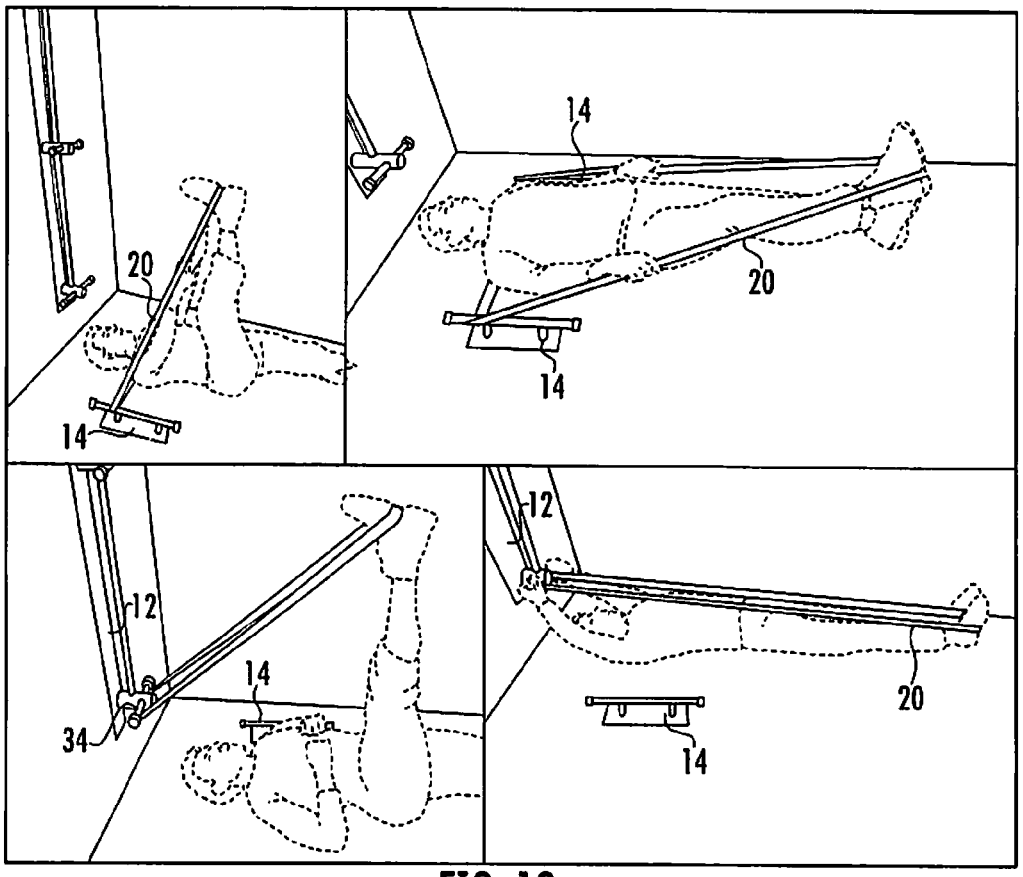

FIG. 12. Hamstring Stretch and Strengthen

Begin by lying on the floor between the two floor stations 14. Take one end of band 20 and loop band under the body and both floor stations 14 or lower cross bar 34 of the wall station 12. Take the other end and loop over one foot while lying flat on back. Feel the stretch and begin to slowly drive the leg with knee straight and foot flexed towards the floor, bring leg back to full hamstring stretched position and repeat.

Figure 13:
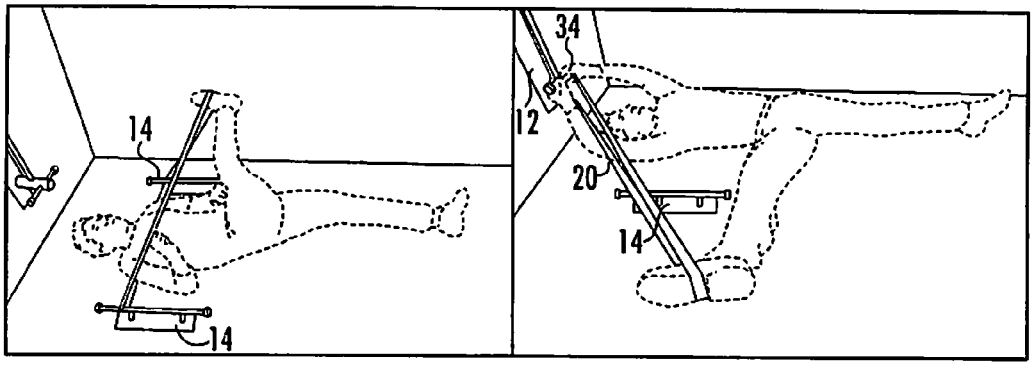

FIG. 13. Total Hip Sweep

Begin by lying on the floor between two floor stations 14. Take one end of band 20 and loop band 20 under the arms and both floor stations 14. Take the other end and loop over one foot while lying flat on back. Alternately, the lower cross bar 34 of the wall station 12 can be used.

Lying back bring right foot with band 20 up to 90 degrees while opposite leg is lying perfectly straight. From here begin to rotate to the right while creating a nice adductor inner leg stretch, while keeping the opposite leg on the floor. Move slowly as you breathe into the stretch. Return up to center of the body and then sweep the leg over to the left side to stretch the hip and butt area. Return to center. Repeat with opposite side. Be sure not to bounce.

Figure 14:
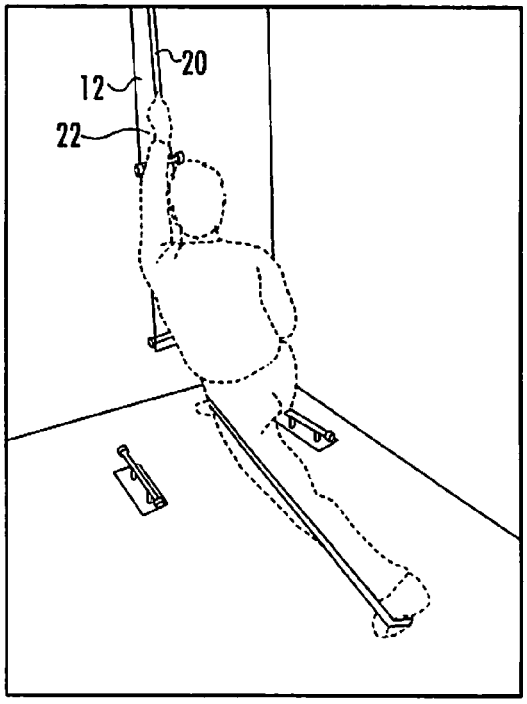

FIG. 14. Hip Flexor/Psoas Stretch

Loop one end of the band 20 around the top cross bar 34 on wall station 12. Stand and place one foot in the other end of band 20 and the opposite foot close to the wall station 12. With banded foot, slowly step back into a reverse lunge position while placing band along the inside of the hip. Lunge and stretch deeply into the movement. Then slowly move the hips up and down and then side-to-side stretching through two planes of motion as you maintain the lunged position.

Figure 15:
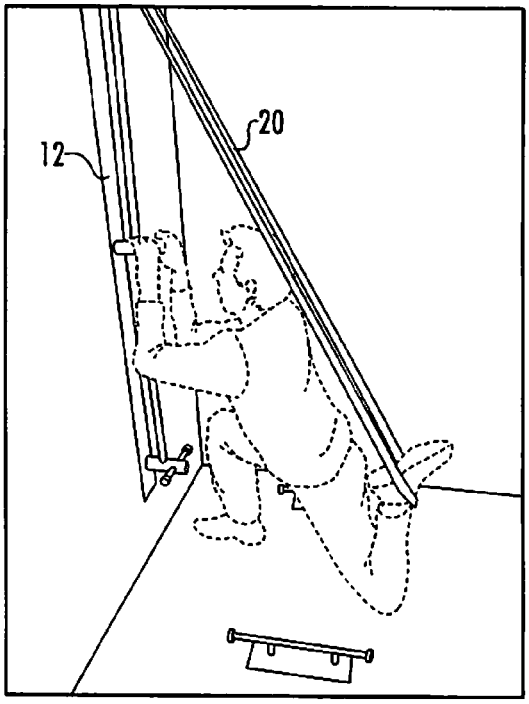

FIG. 15. Quadriceps Stretch

Loop one end of the band 20 around the top cross bar 34 on wall station 12. Stand and place one foot in the other end of band 20 and the opposite foot close to the wall station 12. Drop down placing one knee on floor while moving into a semi-lunge position. Then move stretched hip and thigh slowly forward and back and then side to side stretching through 2 planes of motion. Place towel under knee if needed for comfort.

Figure 16:
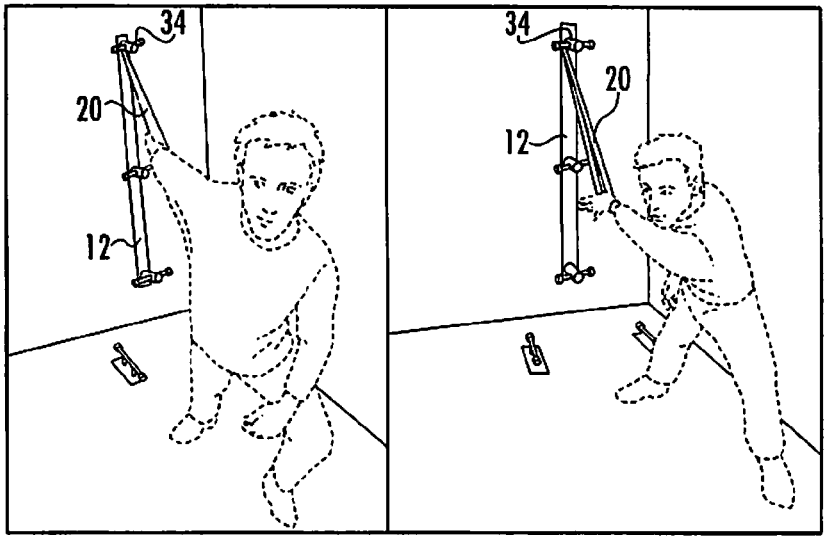

FIG. 16. Total Shoulder Stretch

Loop band 20 around the top cross bar 34 of the wall station 12. Take one arm and loop opposite end around the wrist and hand. Step out sideways while pulling on shoulder creating a distraction stretch on the shoulder, from here rotate and stretch frontal deltoid and then turn and stretch rear deltoid and rhomboids. Switch, distract and stretch other shoulder.

Figure 17:
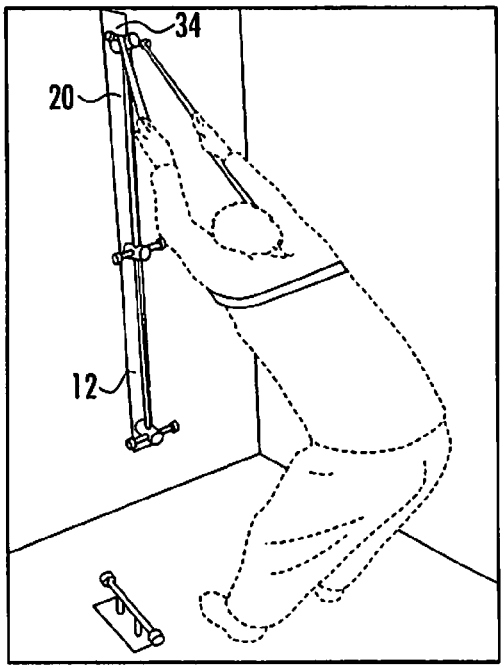

FIG. 17. Total Back Stretch

Loop band 20 around the top cross bar 34 of the wall station 12. Take other end of band 20 and loop under both arms and around back. With knees slightly bent assume strong upright position. Then release and arch back in rounded cat like position. Slowly move hips forward and backward and then moving hips side to side to traction while stretching upper and lower back through two planes of motion.

Figure 18:
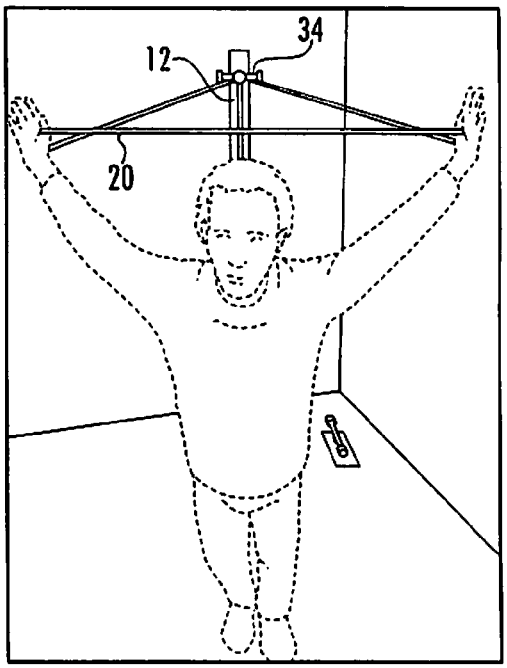

FIG. 18. Chest Stretch

With band 20 looped around middle or top cross bar 34 of wall station 12, grab other end of band 20 approximately 18 inches apart, turn and spin facing opposite direction opening arms above head to letter Y position and then allow arms to drop back body to create chest stretch.

Figure 19:
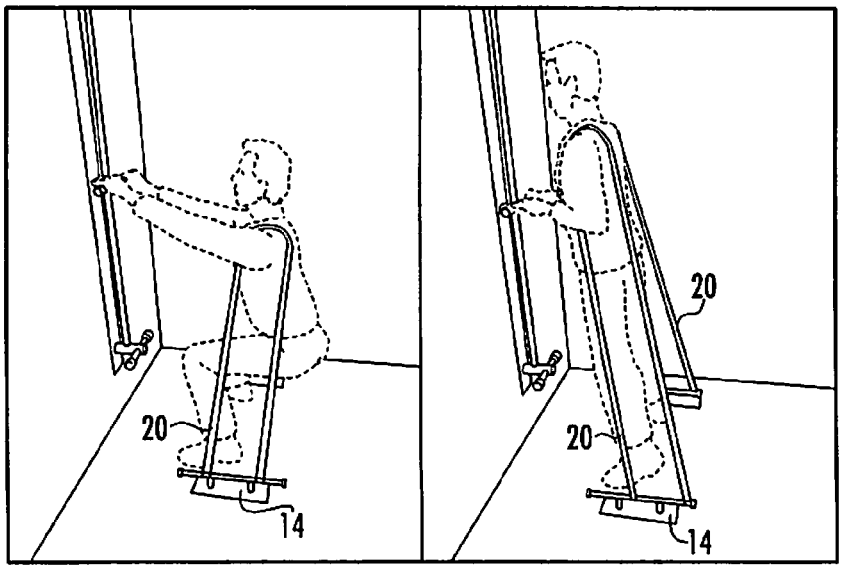

FIG. 19. Speed Squats

Sit on step stool directly in front off both floor stations 14. Loop one of two bands 20 around each floor station 14 while securing other ends with a squat strap. Place squat strap up and overhead and rest on back shoulders. From a seated position stand up to a full flexed extended position and then return to sitting position. Repeat.

Figure 20:
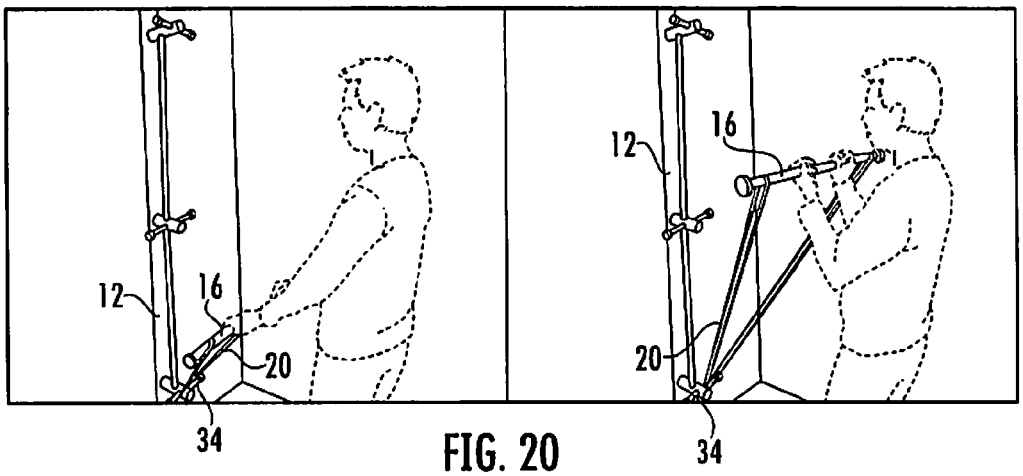

FIG. 20. Biceps Using Exercise Bar 16

Standing 2 feet away from Floor station or Wall station, loop two of the same bands 20 around both floor stations 14 or around any of the three cross bars 34 on the wall station 12 to vary angles of the exercise. Take the other end of both bands 20 and loop on to exercise bar 16. While holding exercise bar 16 in both hands perform a standing biceps curl. Release bar 16 back to starting position and repeat.

Figure 21:
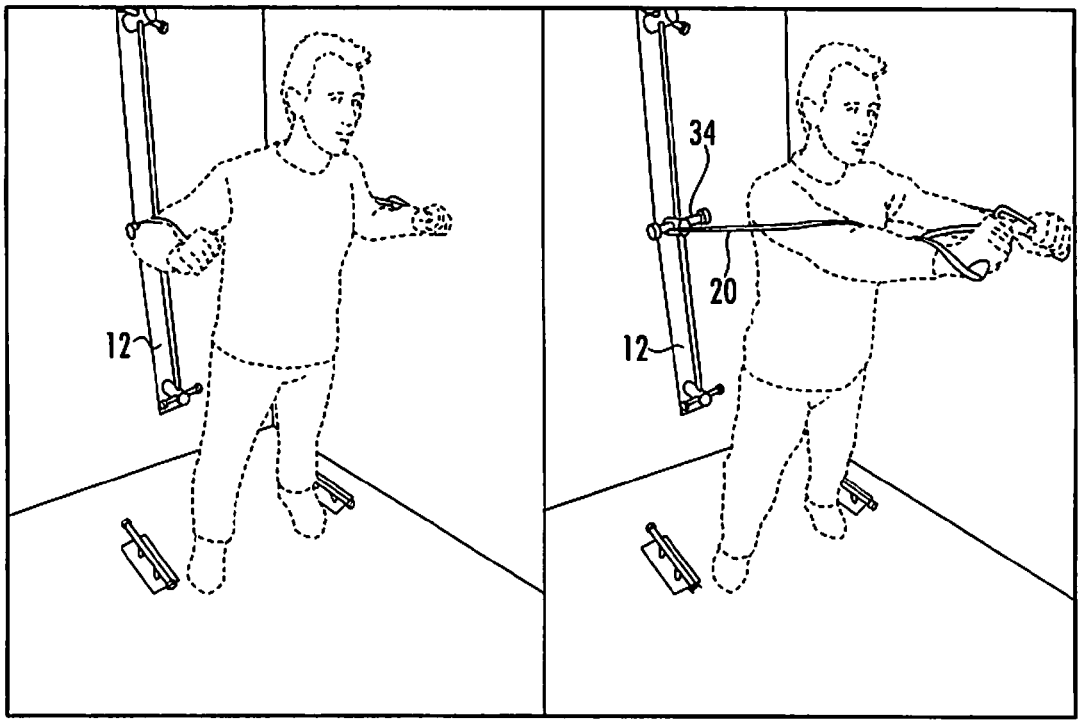

FIG. 21. Standing Chest Press with Handles and Clips

Stand facing wall station 12 approximately 3 feet away. Clip workout handles onto a band 20 while looping center of the band 20 around middle cross bar 34. Grasp workout handles in each hand while rotating and spinning to facing opposite direction. Both workout handles should be chest height. Drive both arms forward creating a chest press strengthening movement. Release back to starting position and repeat.

Figure 22:
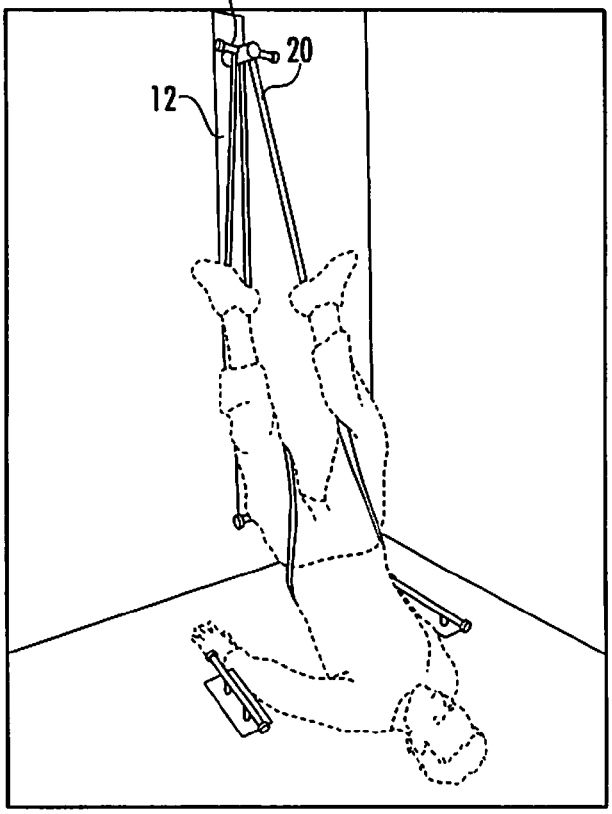

FIG. 22. Hanging Lumbar Traction

Stand facing wall station 12 while looping band 20 up and over top cross bar 34. Take other end of band 20 and loop over head and shoulders. Begin to lay back and down allowing the band 20 to work its way up the body and lock into hip area. Now lying flat on the back take each leg and loop it up and over band 20 to create an upside down hanging position. Relax and breathe. Shift the hips back and forth slightly creating lumbar traction with movement on the low back.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A resistance band physical training apparatus comprising:

a wall station having an elongated wall station rod mountable in a vertical orientation, a plurality of wall station cross bars extending perpendicularly to the elongated wall station rod, each of the wall station cross bars having a wall station plate on at least one end thereof, a wall station plate diameter being greater than a wall station cross bar diameter, and at least one wall station post extending perpendicularly to the elongated wall station rod and the plurality of wall station cross bars for holding the elongated wall station rod and the plurality of wall station cross bars parallel to and spaced apart from a vertical mounting surface;

wherein the wall station is adapted to releasably accommodate at least one resistance band to facilitate exercise therewith.

2. The resistance band physical training apparatus of claim 1, further comprising a wall station back plate having a plurality of wall station mounting points formed therein for secure attachment to the vertical mounting surface, the at least one wall station post extending perpendicularly from the wall station back plate.

3. The resistance band physical training apparatus of claim 1, wherein at least one of the plurality of wall station cross bars is connected directly to the at least one wall station post.

4. The resistance band physical training apparatus of claim 1, wherein the elongated wall station rod and at least one of the plurality of wall station cross bars extend through the at least one wall station post.

5. The resistance band physical training apparatus of claim 1, further comprising at least a first additional wall station post for holding the elongated wall station rod and the plurality of wall station cross bars parallel to and spaced apart from the vertical mounting surface, the first additional wall station post also extending perpendicularly to the elongated wall station rod and the plurality of wall station cross bars.

6. The resistance band physical training apparatus of claim 5, wherein each of the plurality of wall station cross bars is connected directly to a corresponding one of the wall station posts.

7. The resistance band physical training apparatus of claim 5, wherein the elongated wall station rod is connected directly to both of the wall station posts.

8. The resistance band physical training apparatus of claim 1, further comprising at least two additional wall station posts for holding the elongated wall station rod and the plurality of wall station cross bars parallel to and spaced apart from the vertical mounting surface, the two additional wall station posts both also extending perpendicularly to the elongated wall station rod and the plurality of wall station cross bars.

9. The resistance band physical training apparatus of claim 8, wherein each of the plurality of wall station cross bars is connected directly to a corresponding one of the wall station posts, and the elongated wall station rod is connected directly to all of the wall station posts.

10. The resistance band physical training apparatus of claim 9, further comprising a wall station back plate having a plurality of wall station mounting points formed therein for secure attachment to the vertical mounting surface, all the wall station posts extending perpendicularly from the wall station back plate.

11. The resistance band physical training apparatus of claim 1, further comprising:

at least one floor station having an elongated floor station rod mountable in a vertical orientation spaced apart from and perpendicular to the elongated wall station rod, the elongated floor station rod having a floor station plate on at least one end thereof, a floor station plate diameter being greater than a floor station elongated rod diameter, and at least one floor station post extending perpendicularly to the elongated floor station rod for holding the elongated floor station rod parallel to and spaced apart from a horizontal mounting surface;

wherein the floor station is also adapted to releasably accommodate the at least one resistance band to facilitate exercise therewith.

12. The resistance band physical training apparatus of claim 11, further comprising at least one additional floor station identical to the at least one floor station.

13. The resistance band physical training apparatus of claim 11, further comprising the vertical mounting surface and the horizontal mounting surface, the wall station and the at least one floor station being respectively connected thereto.

14. The resistance band physical training apparatus of claim 13, wherein the vertical mounting surface is a wall and the horizontal mounting surface is a floor.

15. The resistance band physical training apparatus of claim 11, further comprising at least one exercise bar connectable to the wall station and the at least one floor station by the at least one resistance band, the at least one exercise bar having an exercise bar plate on at least one end thereof, an exercise bar plate diameter being greater than an exercise bar diameter.

16. The resistance band physical training apparatus of claim 1, further comprising the at least one resistance band.

17. A resistance band physical training apparatus comprising:

a vertical mounting surface;

a horizontal mounting surface;

a wall station mounted to the vertical mounting surface having a vertically mounted elongated wall station rod, a plurality of wall station cross bars extending perpendicularly to the elongated wall station rod, each of the wall station cross bars having a wall station plate on at least one end thereof, a wall station plate diameter being greater than a wall station cross bar diameter, and at least one wall station post extending perpendicularly to the elongated wall station rod and the plurality of wall station cross bars, the at least one wall station post holding the elongated wall station rod and the plurality of wall station cross bars parallel to and spaced apart from a vertical mounting surface; and a pair of floor stations mounted to the horizontal mounting surface, each floor station having an elongated floor station rod mounted in a vertical orientation spaced apart from and perpendicular to the elongated wall station rod, the elongated floor station rod having a floor station plate on at least one end thereof, a floor station plate diameter being greater than a floor station elongated rod diameter, and at least one floor station post extending perpendicularly to the elongated floor station rod, the at least one floor station post holding the elongated floor station rod parallel to and spaced apart from the horizontal mounting surface; and at least one resistance band releasably accommodatable by the wall station, either of the floor stations, or a combination thereof to facilitate exercise therewith.

18. The system of claim 17, wherein the wall station and the floor stations all include respective wall and floor station back plates, each of the wall and floor station back plates being secured to the respective vertical and horizontal mounting surfaces.

19. The system of claim 17, further comprising an exercise bar releasably attachable to the wall station, either of the floor stations, or a combination thereof by the at least one resistance band.

20. A method of using the resistance band physical training apparatus of claim 17, the method comprising:

arranging one end of the at least one resistance band about an end of one of the wall station cross bars, the floor station rods, or a combination thereof; and performing an exercise therewith.

* * * * *